US007229531B2

(12) United States Patent
Yook et al.

(10) Patent No.: US 7,229,531 B2
(45) Date of Patent: Jun. 12, 2007

(54) METHOD OF SEAMING A MULTIAXIAL PAPERMAKING FABRIC TO PREVENT YARN MIGRATION

(75) Inventors: Steven S. Yook, Glens Falls, NY (US); Michael A. Royo, Delmar, NY (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/844,744

(22) Filed: May 12, 2004

(65) Prior Publication Data

US 2005/0252567 A1 Nov. 17, 2005

(51) Int. Cl.
*D21F 7/10* (2006.01)

(52) U.S. Cl. ..... 162/358.2; 162/900; 162/904; 28/142

(58) Field of Classification Search ..... 162/116, 162/117, 358.1, 358.2, 306, 348, 361, 362, 162/900–904; 28/110, 142; 428/57–60, 428/192, 193; 24/33 C, 33 P; 139/383 A, 139/425 A, 383 AA; 442/185, 186, 239–241, 442/268–271; 245/10
See application file for complete search history.

(56) References Cited

U.S. PATENT DOCUMENTS 2,907,093 A * 10/1959 Draper, Jr. ..... 28/141
3,110,078 A * 11/1963 Birger ..... 34/95
4,103,717 A * 8/1978 Clark ..... 139/383 A
4,640,810 A 2/1987 Laursen et al.
5,167,764 A 12/1992 Nielsen et al.
5,225,269 A * 7/1993 Bohlin ..... 442/207
5,360,656 A 11/1994 Rexfelt et al.
5,476,123 A 12/1995 Rydin
5,750,151 A 5/1998 Brignola et al.
5,787,936 A * 8/1998 Snipes ..... 139/383 AA
5,916,421 A 6/1999 Yook
5,939,176 A 8/1999 Yook
6,117,274 A 9/2000 Yook
6,194,331 B1 * 2/2001 Elkins ..... 442/225

FOREIGN PATENT DOCUMENTS

WO WO 02/35000 A 5/2002

* cited by examiner

*Primary Examiner*—Eric Hug
(74) *Attorney, Agent, or Firm*—Frommer Lawrence & Haug LLP; Ronald R. Santucci

(57) ABSTRACT

A method of seaming an on-machine-seamable multiaxial papermaker's fabric to prevent yarn migration. The multiaxial fabric is in the form of an endless loop flattened into two layers along fold lines. CD yarns are removed from the folds to create ravel areas. This leaves the MD yarns unbound in the ravel areas. Seam loops are then formed from the unbound MD yarns at the folds. A thin porous material is sewn to the fabric at each fold. The porous material binds the CD yarns along the edges of the ravel areas while allowing passage of the seam loops through the material. The laminate prevents migration of CD yarn tails into the seam area.

16 Claims, 8 Drawing Sheets

METHOD OF SEAMING A MULTIAXIAL PAPERMAKING FABRIC TO PREVENT YARN MIGRATION

BACKGROUND OF THE INVENTION

1. Field of the Invention

The present invention relates to the seaming of multiaxial fabrics on a papermaking machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates primarily to the fabrics used in the press section, generally known as press fabrics, but it may also find application in the fabrics used in the forming and dryer sections, as well as in those used as bases for polymer-coated paper industry process belts, such as, for example, long nip press belts.

Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fulfill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are used in a wide variety of styles designed to meet the requirements of the paper machines on which they are installed for the paper grades being manufactured. Generally, they comprise a woven base fabric into which has been needled a batting of fine, non-woven fibrous material. The base fabrics may be woven from monofilament, plied monofilament, multifilament or plied multifilament yarns, and may be single-layered, multi-layered or laminated. The yarns are typically extruded from any one of several synthetic polymeric resins, such as polyamide and polyester resins, used for this purpose by those of ordinary skill in the paper machine clothing arts.

Woven fabrics take many different forms. For example, they may be woven endless, or flat woven and subsequently rendered into endless form with a seam. Alternatively, they may be produced by a process commonly known as modified endless weaving, wherein the widthwise edges of the base fabric are provided with seaming loops using the machine-direction (MD) yarns thereof. In this process, the MD yarns weave continuously back and forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are seamed together. To facilitate seaming, many current fabrics have seaming loops on the crosswise edges of the two ends of the fabric. The seaming loops themselves are often formed by the machine-direction (MD) yarns of the fabric. The seam is typically formed by bringing the two ends of the fabric press together, by interdigitating the seaming loops at the two ends of the fabric, and by directing a so-called pin, or pintle, through the passage defined by the interdigitated seaming loops to lock the two ends of the fabric together.

Further, the woven base fabrics may be laminated by placing one base fabric within the endless loop formed by another, and by needling a staple fiber batting through both base fabrics to join them to one another. One or both woven base fabrics may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce press fabrics, and other paper machine clothing, to the dimensions required to fit particular positions in the paper machines of their customers. Needless to say, this requirement makes it difficult to streamline the manufacturing process, as each press fabric must typically be made to order.

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. While many fabrics are endless, about half of those used in press sections of the paper machines today are on-machine-seamable. Some Paper Industry Process Belts (PIPBs) are contemplated to have an on machine seam capability, such as some transfer belts, known as Transbelt®. Installation of the fabric includes pulling the fabric body onto a machine and joining the fabric ends to form an endless belt.

In response to this need to produce press fabrics in a variety of lengths and widths more quickly and efficiently, press fabrics have been produced in recent years using a spiral winding technique disclosed in commonly assigned U.S. Pat. No. 5,360,656 to Rexfelt et al., the teachings of which are incorporated herein by reference.

U.S. Pat. No. 5,360,656 shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the spirally continuous seam so produced may be closed by sewing, stitching, melting, welding (e.g. ultrasonic) or gluing. Alternatively, adjacent longitudinal edge portions of adjoining spiral turns may be arranged overlappingly, so long as the edges have a reduced thickness, so as not to give rise to an increased thickness in the area of the overlap. Alternatively still, the spacing between lengthwise yarns may be increased at the edges of the strip, so that, when adjoining spiral turns are arranged overlappingly, there may be an unchanged spacing between lengthwise threads in the area of the overlap.

In any case, a woven base fabric, taking the form of an endless loop and having an inner surface, a longitudinal (machine) direction and a transverse (cross-machine) direction, is the result. The lateral edges of the woven base fabric are then trimmed to render them parallel to its longitudinal (machine) direction. The angle between the machine direction of the woven base fabric and the spirally continuous seam may be relatively small, that is, typically less than 10°. By the same token, the lengthwise (warp) yarns of the woven fabric strip make the same relatively small angle with the longitudinal (machine) direction of the woven base fabric. Similarly, the crosswise (filling) yarns of the woven fabric strip, being perpendicular to the lengthwise (warp) yarns, make the same relatively small angle with the transverse (cross-machine) direction of the woven base fabric. In short, neither the lengthwise (warp) nor the crosswise (filling) yarns of the woven fabric strip align with the longitudinal (machine) or transverse (cross-machine) directions of the woven base fabric.

A press fabric having such a base fabric may be referred to as a multiaxial press fabric. Whereas the standard press fabrics of the prior art have three axes: one in the machine direction (MD), one in the cross-machine direction (CD), and one in the z-direction, which is through the thickness of the fabric, a multiaxial press fabric has not only these three axes, but also has at least two more axes defined by the directions of the yarn systems in its spirally wound layer or layers. Moreover, there are multiple flow paths in the z-direction of a multiaxial press fabric. As a consequence, a multiaxial press fabric has at least five axes. Because of its multiaxial structure, a multiaxial press fabric having more than one layer exhibits superior resistance to nesting and/or to collapse in response to compression in a press nip during the papermaking process as compared to one having base fabric layers whose yarn systems are parallel to one another.

Until recently, multiaxial press fabrics of the foregoing type had been produced only in endless form. As such, their use had been limited to press sections having cantilevered press rolls and other components, which permit an endless press fabric to be installed from the side of the press section. However, their relative ease of manufacture and superior resistance to compaction contributed to an increased interest and a growing need for a multiaxial press fabric which could be seamed into endless form during installation on a press section, thereby making such press fabric available for use on paper machines lacking cantilevered components. On-machine-seamable multiaxial press fabrics, developed to meet this need, are shown in commonly assigned U.S. Pat. Nos. 5,916,421; 5,939,176; and 6,117,274 to Yook, the teachings of which are incorporated herein by reference.

U.S. Pat. No. 5,916,421 shows an on-machine-seamable multiaxial press fabric for the press section of a paper machine made from a base fabric layer assembled by spirally winding a fabric strip in a plurality of contiguous turns, each of which abuts against and is attached to those adjacent thereto. The resulting endless base fabric layer is flattened to produce first and second plies joined to one another at folds at their widthwise edges. Crosswise yarns are removed from each turn of the fabric strip at folds at the widthwise edges to produce unbound sections of lengthwise yarns. A seaming element, having seaming loops along one of its widthwise edges, is disposed between the first and second fabric plies at each of the folds at the two widthwise edges of the flattened base fabric layer. The seaming loops extend outwardly between the unbound sections of the lengthwise yarns from between the first and second fabric plies. The first and second fabric plies are laminated to one another by needling staple fiber batting material therethrough. The press fabric is joined into endless form during installation on a paper machine by directing a pintle through the passage formed by the interdigitation of the seaming loops at the two widthwise edges.

U.S. Pat. No. 5,939,176 also shows an on-machine-seamable multiaxial press fabric. Again, the press fabric is made from a base fabric layer assembled by spirally winding a fabric strip in a plurality of contiguous turns, each of which abuts against and is attached to those adjacent thereto. The resulting endless fabric layer is flattened to produce a first and second fabric plies joined to one another at folds at their widthwise edges. Crosswise yarns are removed from each turn of the fabric strip at the folds at the widthwise edges to produce seaming loops. The first and second plies are laminated to one another by needling staple fiber batting material therethrough. The press fabric is joined into endless form during installation on a paper machine by directing a pintle through the passage formed by the interdigitation of the seaming loops at the two widthwise edges.

Finally, in U.S. Pat. No. 6,117,274, another on-machine-seamable multiaxial press fabric is shown. Again, the press fabric is made from a base fabric layer assembled by spirally winding a fabric strip in a plurality of contiguous turns, each of which abuts against and is attached to those adjacent thereto. The resulting endless fabric layer is flattened to produce a first and second fabric plies joined to one another at folds at their widthwise edges. Crosswise yarns are removed from each turn of the fabric strip at the folds at the widthwise edges to produce unbound sections of lengthwise yarns. Subsequently, an on-machine-seamable base fabric, having seaming loops along its widthwise edges, is disposed between the first and second fabric plies of the flattened base fabric layer. The seaming loops extend outwardly between the unbound sections of the lengthwise yarns from between the first and second fabric plies. The first fabric ply, the on-machine-seamable base fabric and the second fabric ply are laminated to one another by needling staple fiber batting material therethrough. The press fabric is joined into endless form during installation on a paper machine by directing a pintle through the passage formed by the interdigitation of the seaming loops at the two widthwise edges.

A seam is generally a critical part of a seamed fabric, since uniform paper quality, low marking and excellent runnability of the fabric require a seam which is as similar as possible to the rest of the fabric in respect of properties such as thickness, structure, strength, permeability etc. It is important that the seam region of any workable fabric behave under load and have the same permeability to water and to air as the rest of the fabric, thereby preventing periodic marking of the paper product being manufactured by the seam region. Despite the considerable technical obstacles presented by these seaming requirements, it is highly desirable to develop seamable fabrics, because of the comparative ease and safety with which they can be installed.

As discussed above in reference to U.S. Pat. No. 5,939,176, a CD area of the multiaxial fabric is raveled out and the fabric is then folded over in this raveled area to produce seaming loops. A drawback to this approach of creating a seam in the multiaxial fabric structure is the CD yarn tails that result in the seam area. These tails are a function of the CD yarn angle which is linked to the panel width, fabric length and panel skew. These yarn tails are not anchored into the base weave and are free to move or "migrate" into the seam area. This problem is known as yarn migration. When this migration occurs, the CD ends move into the seam area and impede seaming (sometimes significantly). In addition, these unbound yarns do not provide suitable uniform support for the fiber batting material in the seam area.

Attempts have been made to use certain adhesives to bind these yarns and prevent migration, but with limited success. Therefore, a need exists for a method of preventing yarn migration in the seam area of multiaxial fabrics.

SUMMARY OF THE INVENTION

The present invention is a method of seaming multiaxial fabrics. The method provides a solution to the problem of yarn migration in the seam area.

It is therefore an object of the invention to overcome the above mentioned problems when seaming a papermaking fabric.

Accordingly, the present invention is both a method for manufacturing a papermaker's fabric, and the fabric made in accordance with the method.

The present invention is a method of seaming an on-machine-seamable multiaxial papermaker's fabric. The fabric is in the form of an endless loop flattened into two layers along a first fold and a second fold. Yarns in the cross-machine direction (CD) are removed from the first and second folds to create ravel areas. This leaves the yarns in the machine direction (MD) unbound in the ravel areas. Seam loops are formed from the unbound MD yarns at the first and second folds. A thin porous material is attached in a continuous fashion to both of the outer surfaces and CD edges of the fabric at each fold. The material binds the CD yarns along the CD edges of the ravel areas while allowing passage of the seam loops through the material. The fabric is seamed by interdigitating the seam loops from the first and second folds and inserting a pintle therethrough.

Other aspects of the present invention include that the yarns in the fabric are at a slight angle with respect to the CD and MD; and therefore some of the yarns removed in the CD along the edges of the ravel areas do not extend across the entire width of the fabric. This leaves both complete yarns and small segments of CD yarn; both of which are problematic if they migrate into the seam loop area. The fabric is formed of a woven fabric strip having a width that is less than a width of the fabric, the fabric strip being in the form of a multi-layer weave with two lateral edges; wherein the lateral edges are formed such that when the fabric strip is wound around in a continuous spiral fashion to form the fabric, the lateral edges abutting or overlapping one another to form a spiral wound seam.

Still further aspects of the present invention include that the fabric is preferably an on-machine-seamable multiaxial press fabric for the press section of a paper machine. Preferably, the thin porous material may be a polyamide scrim material. At least one layer of staple fiber batting material may be needled into the fabric. At least some of the yarns may be one of polyamide, polyester, polybutylene terephthalate (PBT), or any other resin commonly used to form yarns in the manufacturing of papermaking fabrics. Any of the yarns may have a circular cross-sectional shape, a rectangular cross-sectional shape or a non-round cross-sectional shape.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 1:
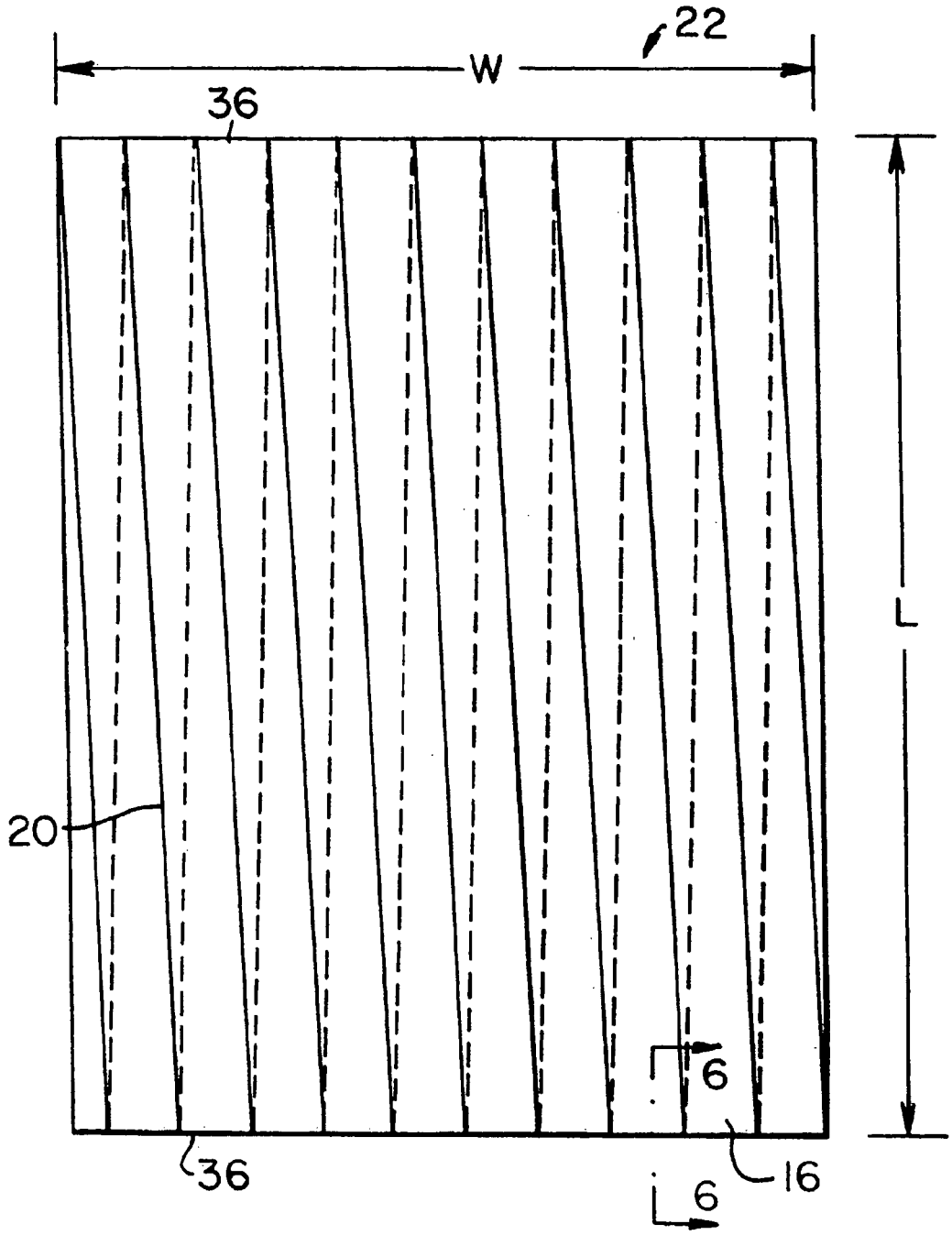
FIG. 1 is a top plan view of a multiaxial base fabric in a flattened condition.

The preferred embodiments of the present invention will now be described by reference to FIG. 1. FIG. 1 is a top plan view of a multiaxial base fabric in a flattened condition. Once the base fabric 22 has been assembled, as taught in commonly assigned U.S. Pat. Nos. 5,916,421; 5,939,176; and 6,117,274 to Yook described hereinabove, it is flattened as shown in the plan view presented in FIG. 1. This places base fabric layer 22 into the form of a two-ply fabric of length, L, which is equal to one half of the total length, C, of the base fabric layer 22 and width, W. Seam 20 between adjacent turns of woven fabric strip 16 slants in one direction in the topmost of the two plies, and in the opposite direction in the bottom ply, as suggested by the dashed lines in FIG. 1. Flattened base fabric layer 22 has two widthwise edges 36.

Figure 3:
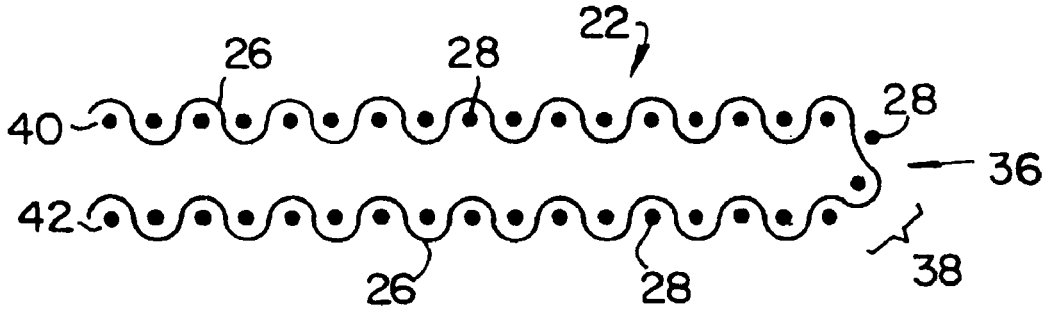
FIG. 3 is a schematic cross-sectional view of the flattened base fabric layer taken as indicated by line 6—6 in FIG. 1.
Figure 4:
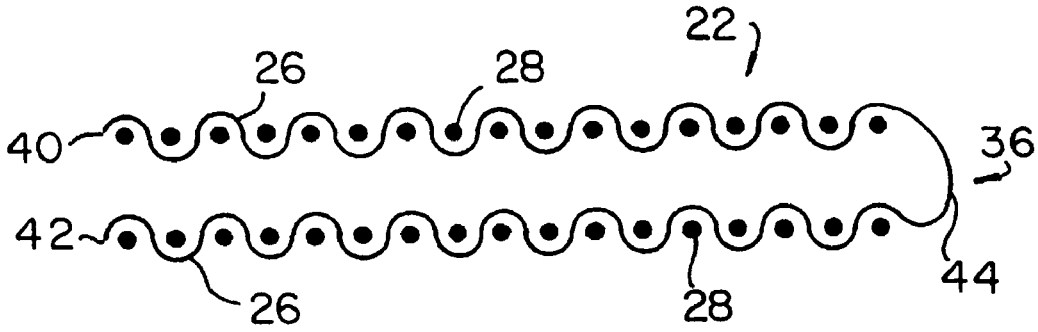
FIG. 4 is a schematic cross-sectional view, analogous to that provided in FIG. 3, following folding along the ravel area.

FIG. 3 is a schematic cross-sectional view taken as indicated by line 6-6 in FIG. 1. In accordance with the present invention, a plurality of crosswise yarns 28 of fabric strip 16 and of segments thereof are removed from adjacent the folds 38 to produce a first fabric ply 40 and a second fabric ply 42 joined to one another at their widthwise edges 36 by unbound sections of lengthwise yarns 26. FIG. 4 is a schematic cross-sectional view, analogous to that provided in FIG. 3, of one of the two widthwise edges 36 of the flattened base fabric layer 22 following the removal of the crosswise yarns. These unbound sections 44 of lengthwise yarns 26 ultimately form seaming loops for use in joining the papermaker's fabric to be produced from base fabric layer 22 into endless form during installation on a paper machine, as taught in the '176 Yook patent.

Figure 2:
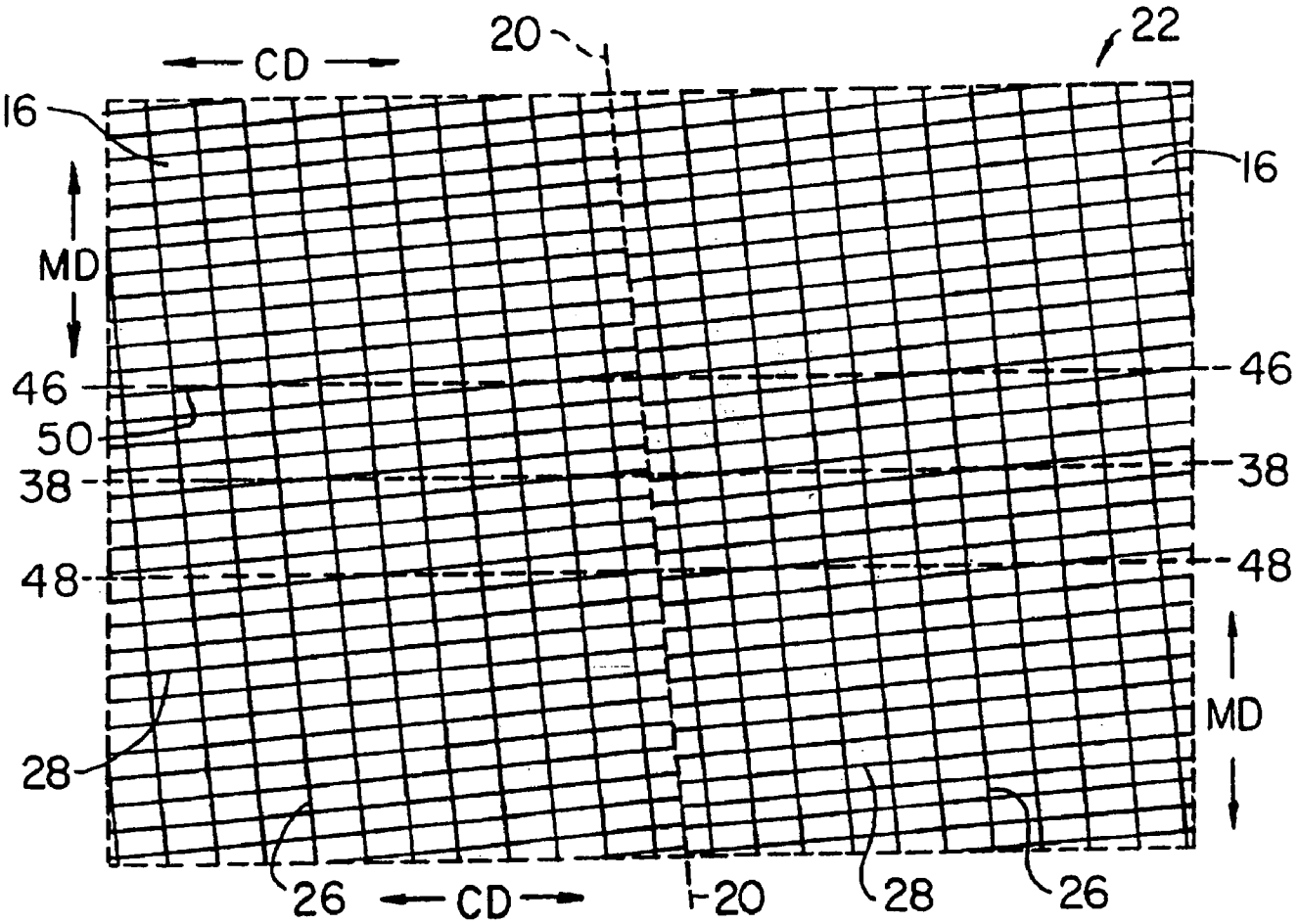
FIG. 2 is a plan view of a portion of the surface of the multiaxial base fabric layer.

FIG. 2 is a plan view of a portion of the surface of the multiaxial base fabric layer at a point on one of the folds 38 near the spirally continuous seam 20 between two adjacent spiral turns of fabric strip 16. Lengthwise yarns 26 and crosswise yarns 28 are at slight angles with respect to the machine direction (MD) and cross-machine direction (CD), respectively.

The fold 38, which is flattened during the removal of the neighboring crosswise yarns 28, is represented by a dashed line in FIG. 2. In practice, the base fabric layer 22 would be flattened, as described above, and the folds 38 at its two widthwise edges 36 marked in some manner, so that its location would be clear when it was flattened. In order to provide the required unbound sections of lengthwise yarns 26 at the fold 38, it is necessary to remove the crosswise yarns 28 from a region, defined by dashed lines 46,48 equally separated from fold 38 on opposite sides thereof. This process, called raveling, creates a ravel area in the fabric.

Figure 5:
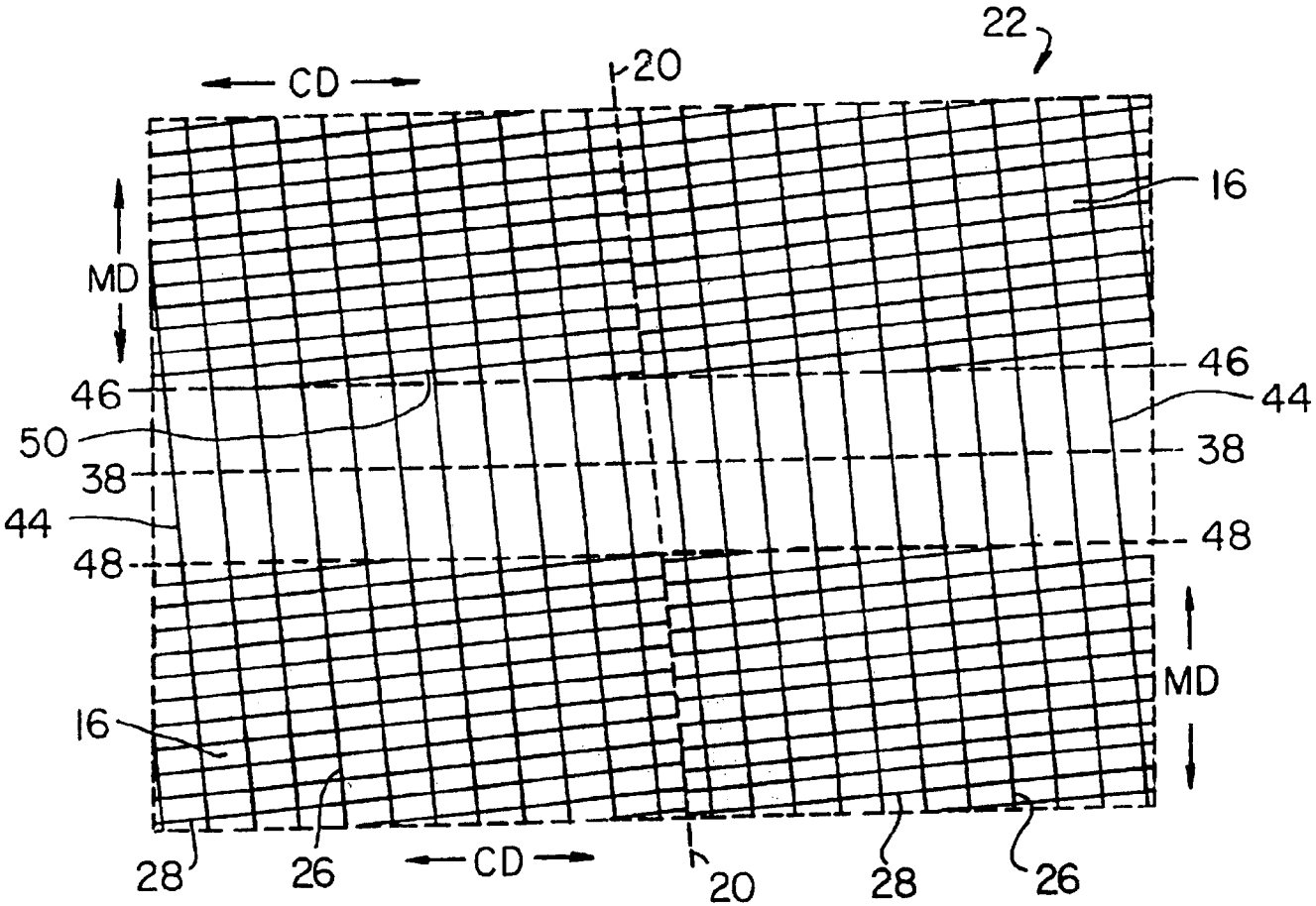
FIG. 5 is a plan view of the portion of the surface of the base fabric layer shown in FIG. 2 following the removal of crosswise yarns to form a ravel area.

FIG. 5 is a plan view of the portion of the surface of the base fabric layer shown in FIG. 2 following the removal of crosswise yarns from the region centered about the fold 38. Unbound sections 44 of lengthwise yarns 26 extend between dashed lines 46,48 in the region of the fold 38. The portion of crosswise yarn 50 which extended past dashed line 46 has been removed, as noted above.

The provision of the unbound sections of lengthwise yarns 26 at the two widthwise edges 36 of the flattened base fabric layer 22 is complicated by two factors. Firstly, because the fabric strip 16 has a smaller width than the base fabric layer 22, its crosswise yarns 28 do not extend for the full width of the base fabric layer 22. Secondly, and more importantly, because the fabric strip 16 is spirally wound to produce base fabric layer 22, its crosswise yarns do not lie in the cross-machine direction of the base fabric layer 22 and therefore are not parallel to the folds 38. Instead, the crosswise yarns 28 make a slight angle, typically less than 10 degrees, with respect to the cross-machine direction of the base fabric layer 22. Accordingly, in order to provide the unbound sections of lengthwise yarns 26 at folds 38, crosswise yarns 28 must be removed in a stepwise fashion from the folds 38 across the width, W, of the base fabric layer 22.

In other words, since the crosswise yarns 28 are not parallel to fold 38 or dashed lines 46,48, in multiaxial fabrics it is often necessary to remove only a portion of a given crosswise yarn 28, such as in the case with crosswise yarn 50 in FIG. 2, in order to clear the space between dashed lines 46,48 of crosswise yarns 28.

Figure 5A:
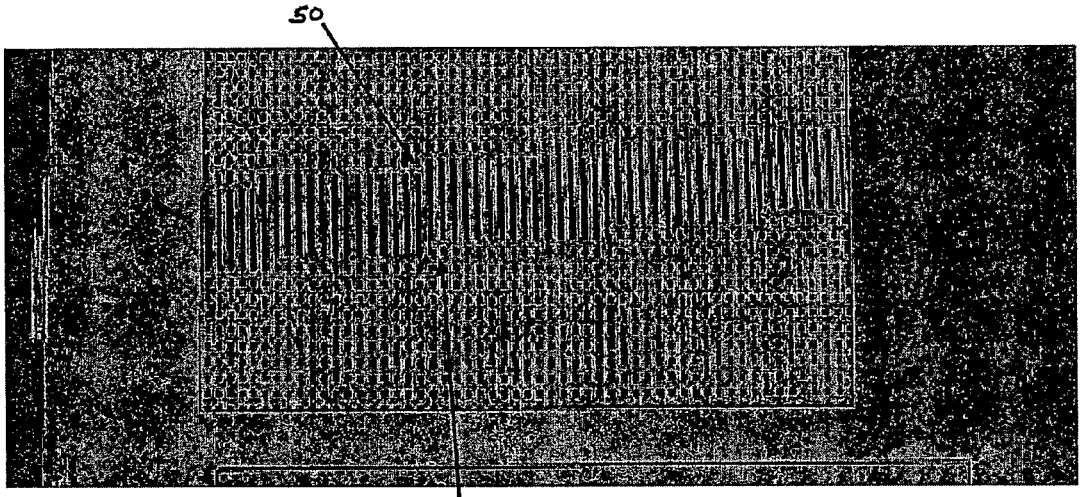
FIG. 5A is a top view of the ravel area in a multiaxial base fabric layer as shown in FIG. 5.

FIG. 5A is a top view of the ravel area in a multiaxial base fabric layer as shown in FIG. 5. Note the CD yarns (horizontal in this view) along the edges of the ravel area do not extend across the entire fabric, but are clipped at some point as they angle into the ravel area. These clipped CD yarns 50 are referred to as CD tails. Because the CD tails do not fully extend across the fabric, they are particularly susceptible to migration into the ravel/seam loop area.

Figure 6:
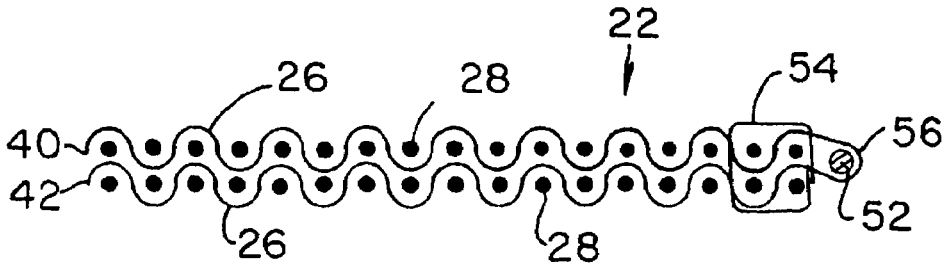
FIG. 6 is a schematic cross-sectional view of the flattened base fabric showing the formation of seaming loops along the fold.

FIG. 6 is a schematic cross-sectional view of the flattened base fabric showing an exemplary method of forming seaming loops along the fold. In this particular method, a loop-forming cable 52 is installed between first fabric ply 40 and second fabric ply 42 and against unbound sections of lengthwise yarns 26. Stitches 54, for example, may be made to connect first fabric ply 40 to second fabric ply 42 adjacent to loop-forming cable 52 to form seaming loops 56 from the unbound sections of the lengthwise yarns 26. Alternatively, first fabric ply 40 may be connected to second fabric ply 42 adjacent to loop-forming cable 52 by any of the other means used for such a purpose by those or ordinary skill in the art. Loop-forming cable 52 is then removed leaving the seaming loops 56 formed in the foregoing manner at the two widthwise edges 36 of the flattened base fabric layer 22.

Figure 7:
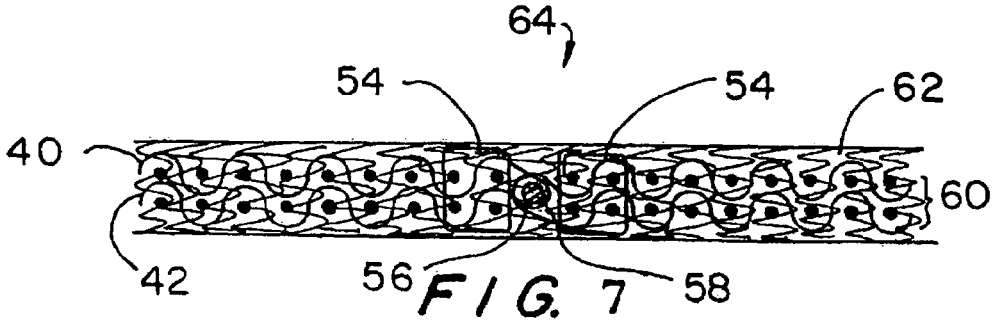
FIG. 7 is a schematic cross-sectional view of a seamed multiaxial press fabric as installed on a papermaking machine.

FIG. 7 is a schematic cross-sectional view of a seamed multiaxial press fabric as installed on a papermaking machine. FIG. 7 shows a laminated fabric comprising the flattened, raveled at both folds with projecting seam loops base fabric layer 22 resulting in an on-machine-seamable base fabric 60. The layers of on-machine-seamable base fabric 60 are joined to one another by one or more layers of staple fiber batting material 80 needled into and through the base fabric 60 to complete the manufacture of the present on-machine-seamable laminated multiaxial press fabric. The staple fiber batting material 80 is of a polymeric resin material, and preferably is of a polyamide or polyester resin. The seaming loops 56 of the base fabric layer are interdigitated together and a seam is formed by the insertion of pintle 58.

Figure 8:
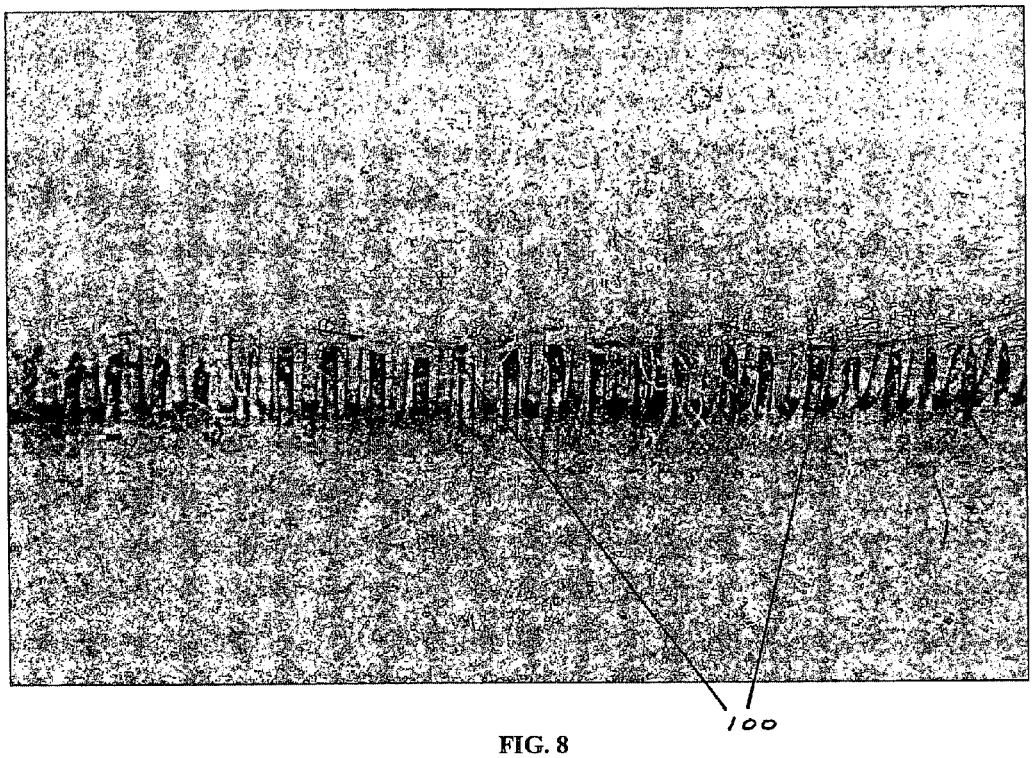
FIG. 8 is a top view of the seam area of a seamed multiaxial press fabric as shown in FIG. 7.

FIG. 8 is a top view of the seam area of a seamed multiaxial press fabric as shown in FIG. 7. As discussed above, a major drawback of inserting a seam into the multiaxial structure are the CD tails that result in the seam area. FIG. 8 shows CD tails 100 which have migrated into the seam area. The tails are a function of the CD yarn angle which is linked to the panel width, fabric length and panel skew of the multiaxial fabric base. These CD yarns are not anchored into the base weave, but free to move or "migrate." Certain adhesive systems have been tried to cement the yarns in place, but with limited success. When migration occurs, the CD ends move into the seam area and impede seaming (sometimes significantly).

Figure 9:
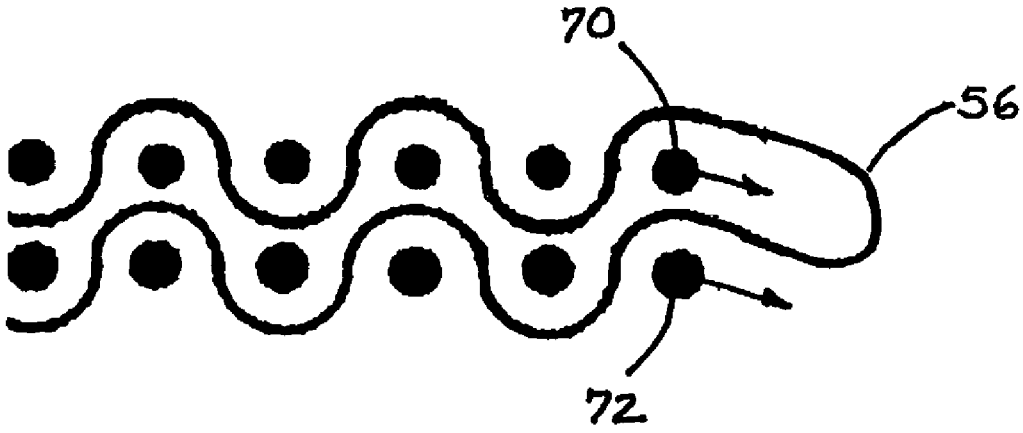
FIG. 9 is an enlarged schematic cross-sectional view of the seam loop area of the flattened base fabric.

FIG. 9 is an enlarged schematic cross-sectional view of the seam loop area of the flattened base fabric. CD yarns or yarn tails 70 and 72 are unbound and may migrate into the seam loop area. Specifically, CD yarn 70 is free to migrate into the seam loop 56 and impede seaming. In addition, CD yarn 72 may also shift around in the seam area and result in further uneven support for the batting material in the seam area. These migrating yarns or yarn tails cause many difficulties when seaming the fabric on the paper machine.

Figure 10:
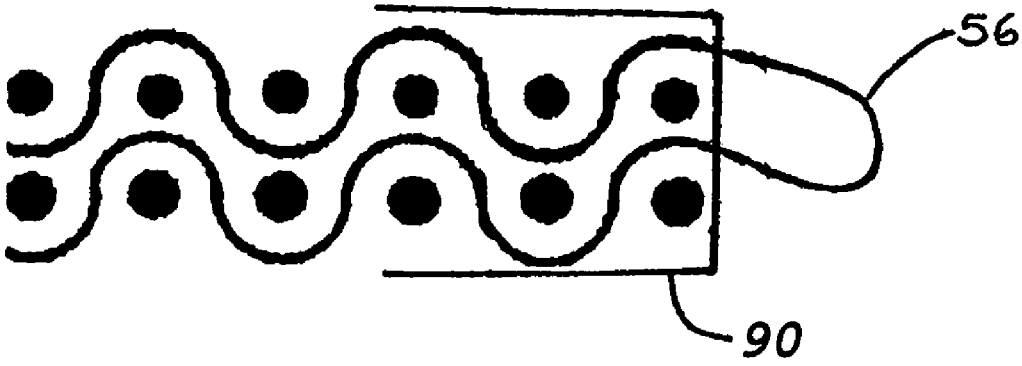
FIG. 10 is an enlarged schematic cross-sectional view of the seam loop area of the flattened base fabric showing installation of the porous material to prevent yarn migration in accordance with the present invention.

FIG. 10 is an enlarged schematic cross-sectional view of the seam loop area of the flattened base fabric showing installation of a thin porous material 90 to prevent yarn migration in accordance with the present invention. To prevent yarn migration, the present invention attaches a thin porous material 90 (woven or nonwoven) to cover the CD edges of the seam loop area to hold the CD yarns and yarn tails in place while allowing the seam loops 56 to pass through the material. The porous material may be a nylon scrim material, or any other suitable material known in the art. The porous material may be sewn to the fabric base, or attached by any other means such as adhesives common in the art.

As discussed above, the thin porous material may be a woven or non-woven scrim material. Such scrim material typically comprises a spun bonded, wet laid or air laid web. Spun bonded webs and their methods of preparation are well known in the art. For example, Bregnala et al. (U.S. Pat. No. 5,750,151), describes the fabrication of spun bonded webs by extrusion of multifilaments derived from thermoplastic polymers, such as polyolefins (polypropylene), polyesters (polyethylene terephthalate, polyamides (nylon-6), and polyurethanes, for industrial use, and an apparatus for drawing the web. Similarly, wet laid webs are fabricated by the method described by Nielsen et al. (U.S. Pat. No. 5,167,764), involving the forming of an aqueous sheet of, for example, cellulose acetate and a polyamide, a polyester, a polypropylene, and drying the sheets. Air laid webs of cellulose fibers and thermoplastics, polyamides, polyesters or polypropylene, are fabricated as described by Lauren et al. (U.S. Pat. No. 4,640,810), by blending fibers of, for example, cellulose acetate and a thermoplastic, such as polypropylene, and distributing the blend in an air stream into the surface of a carrier.

Further, the porous material can be an extruded mesh or a knitted material. It must be porous and flexible enough to allow passage of the seaming loops through the material. It must also be flexible enough to follow the actual contour of the seamed multiaxial base fabric. Various methods of sewing or using adhesive can be used to apply the porous material. For example, the porous material itself can have an adhesive component (a laminate) which is heat activated or at least some of the yarns or fibers making up the porous material can be "hot melts." That is, upon exposure to heat some portion of the material will flow or become sticky and adhere to the multiaxial base. Sheath/core or bi-component fibers and yarns will also work well as material/yarn for the porous material.

The fabric being woven to provide the on-machine-seamable base fabric may be either single or multi-layer, and may be woven from monofilament, plied monofilament or multifilament yarns of a synthetic polymeric resin, such as polyester or polyamide. The weft yarns, which form the seaming loops 56 and are ultimately the lengthwise yarns, are preferably monofilament yarns.

The fabric according to the present invention preferably comprises only monofilament yarns, preferably of polyamide, polyester, or other polymer such as polybutylene terephthalate (PBT). Bicomponent or sheath/core yarns can also be employed. Any combination of polymers for any of the yarns can be used as identified by one of ordinary skill in the art. The CD and MD yarns may have a circular cross-sectional shape with one or more different diameters. Further, in addition to a circular cross-sectional shape, one or more of the yarns may have other cross-sectional shapes such as a rectangular cross-sectional shape or a non-round cross-sectional shape.

Modifications to the above would be obvious to those of ordinary skill in the art, but would not bring the invention so modified beyond the scope of the present invention. The claims to follow should be construed to cover such situations.

What is claimed is:

1. A method of seaming an on-machine-seamable multiaxial papermakerts fabric, the fabric being in the form of an endless loop flattened into two layers along a first fold and a second fold; comprising the steps of:

removing yarns in the cross-machine direction (CD) from the first and second folds to create ravel areas; yams in the machine direction (MD) being unbound in the ravel areas;

forming seam loops from the unbound MD yams at the first and second folds;

attaching a thin porous material to the fabric in a continuous fashion to both out-side surfaces on CD edges of the fabric at each fold; the porous material binding the yarns along the CD edges of the ravel areas while passing the seam loops through the material, wherein the thin porous material wraps from a first outside surface of the fabric to a second outside surface of the fabric and wherein the yarns bound by the thin porous material include CD yarn segments; and seaming the fabric by interdigitating the seam loops from the first and second folds and inserting a pintle therethrough.

2. The method of claim 1, wherein the thin porous material is a polyamide scrim material.

3. The method of claim 1, wherein yarns in the fabric are at a slight angle with respect to the CD and MD; and therefore at least some of the yarns removed in the CD along the edges of the ravel areas do not extend across the entire width of the fabric.

4. The method of claim 1, wherein the fabric is formed of a woven fabric strip having a strip width that is less than a width of the fabric, the fabric strip being in the form of a multi-layer weave with two lateral edges; wherein the lateral edges are formed such that when the fabric strip is wound around in a continuous spiral fashion to form the fabric, the lateral edges either abut or overlap one another to form a spiral wound seam.

5. The method of claim 1, further comprising the step of needling at least one layer of staple fiber batting material into the base fabric.

6. The method of claim 5, wherein the fabric is an on-machine-seamable laminated multiaxial press fabric for the press section of a paper machine.

7. The method of claim 1, wherein at least some of the yarns are one of polyamide, polyester, polybutylene terephthalate (PBT), or bi-component or sheath/core yarns.

8. The method of claim 1, wherein any of the yarns in the base fabric have a circular cross-sectional shape, a rectangular cross-sectional shape or a non-round cross-sectional shape.

9. A papermaker's fabric, comprising:

a multiaxial fabric base in the form of an endless loop flattened into two layers along a first fold and a second fold;

the fabric base having seam loops formed from unbound machine direction (MD) yarns in ravel areas along the first and second folds; the ravel areas being formed by removing yarns in the cross-machine direction (CD), thereby leaving yarns in the MD unbound in the ravel areas;

a thin porous material that wraps from a first outer surface of the fabric to a second outer surface of the fabric base and is attached to both outer surfaces on CD edges of the fabric base at each fold; the porous material binding the yarns along the CD edges of the ravel areas while allowing passage of the seam loops through the material, wherein the yarns bound by the thin porous material include CD yarns segments; and batt fiber needled into the fabric base from at least one surface.

10. The papermaker's fabric of claim 9, wherein the fabric is seamed by interdigitating the seam loops from the first and second CD folds and inserting a pintle there-through.

11. The papermaker's fabric of claim 9, wherein the thin porous material is a polyamide scrim material.

12. The papermaker's fabric of claim 9, wherein yams in the fabric base are at a slight angle with respect to the CD and MD; and therefore at least some of the yarns removed in the CD along the edges of the ravel areas do not extend across the entire width of the fabric.

13. The papermaker's fabric of claim 9, wherein the fabric base is formed of a woven fabric strip having a strip width that is less than a width of the fabric, the fabric strip being woven with two lateral edges; wherein the lateral edges are formed such that when the fabric strip is wound around in a continuous spiral fashion to form the fabric base, the lateral edges either abut or overlap one another to form a spiral wound seam.

14. The papermaker's fabric of claim 9, wherein the fabric is an on-machine-seamable laminated multiaxial press fabric for the press section of a paper machine.

15. The papermaker's fabric of claim 9, wherein at least some of the yarns are one of polyamide, polyester, polybutylene terephthalate (PBT), or bi-component or sheath/core yarns.

16. The papermaker's fabric of claim 9, wherein any of the yarns in the base fabric have a circular cross-sectional shape, a rectangular cross-sectional shape or a non-round cross-sectional shape.

* * * * *